US009365263B1

(12) United States Patent
Dicken

(10) Patent No.: US 9,365,263 B1
(45) Date of Patent: Jun. 14, 2016

(54) HYDRAULIC BAFFLE FOR A FLAT-BOTTOM BOAT

(71) Applicant: Roy Dicken, Poplar Bluff, MO (US)

(72) Inventor: Roy Dicken, Poplar Bluff, MO (US)

( * ) Notice: Subject to any disclaimer, the term of this patent is extended or adjusted under 35 U.S.C. 154(b) by 0 days.

(21) Appl. No.: 14/208,480

(22) Filed: Mar. 13, 2014

Related U.S. Application Data

(60) Provisional application No. 61/920,925, filed on Dec. 26, 2013.

(51) Int. Cl.
*B63B 39/00* (2006.01)
*B63B 17/02* (2006.01)
*B63B 1/40* (2006.01)

(52) U.S. Cl.
CPC ..... *B63B 1/40* (2013.01)

(58) Field of Classification Search
CPC ..... B63B 39/00; B63B 39/005
USPC ..... 114/279–285, 219
See application file for complete search history.

(56) References Cited

U.S. PATENT DOCUMENTS 3,063,399 A * 11/1962 Schuyler ..... B63B 59/02 114/219
3,270,701 A * 9/1966 Kubas ..... B63B 1/18 114/121
3,636,907 A * 1/1972 Scarritt, Sr. ..... B63B 1/20 114/283
3,641,963 A * 2/1972 Chancellor, Jr. ..... B63B 39/06 114/219
4,751,891 A * 6/1988 Wilson ..... B63B 59/02 114/219
4,815,412 A * 3/1989 Cassaro, Jr. ..... B63B 59/00 114/219
4,909,172 A * 3/1990 Hamby ..... B63B 59/02 114/219
4,962,719 A * 10/1990 Hughes ..... B63B 59/02 114/343
5,357,890 A * 10/1994 Mason, Jr. ..... B63B 59/02 114/219
5,465,678 A 11/1995 Ekman
5,485,801 A * 1/1996 Gibbs ..... B63B 59/02 114/219
5,647,296 A 7/1997 Pasanen
5,803,010 A * 9/1998 Roy ..... B63B 59/02 114/219
5,849,390 A * 12/1998 Dillon ..... B60R 7/00 150/166
5,890,448 A * 4/1999 Berresford ..... B63B 59/02 114/219
6,003,465 A 12/1999 Khachatrian et al.
6,148,754 A * 11/2000 Sims, Jr. ..... B63B 59/02 114/219
6,158,376 A * 12/2000 Vorus ..... B63B 39/005 114/279
6,176,190 B1 1/2001 Ozga
6,182,596 B1 * 2/2001 Johnson ..... B63B 1/22 114/279
6,192,818 B1 * 2/2001 Rogers-Smith ..... B63B 59/02 114/219

OTHER PUBLICATIONS http://www.pensacolafishingforum.com/f26/curing-hull-slap-problem-aluminum-jon-boats-156394/ Accessed Aug. 7, 2013.

* cited by examiner

*Primary Examiner* — Lars A Olson
*Assistant Examiner* — Jovon Hayes
(74) *Attorney, Agent, or Firm* — Robert C. Montgomery; Montgomery Patent & Design LLC

(57) ABSTRACT

An apparatus that attaches to the exterior hull of a watercraft is designed to prevent the sound of waves slapping against the side or bottom of the watercraft while fishing. The apparatus comprises a baffling panel arranged along the hull at water line. A plurality of elastic cords, each having hooks, are each affixed to perimeter edges of the baffle panel which connect the apparatus to the watercraft being connected to the upper side of the watercraft. The apparatus can be placed at the front or along any side or rear surface of the watercraft. During use, the watercraft is positioned so that the apparatus faces oncoming waves. Thus, as the waves break against the hull of the watercraft, the wave action is absorbed by the apparatus rather than the large surface of the watercraft, and any resultant sound is suppressed.

7 Claims, 4 Drawing Sheets

HYDRAULIC BAFFLE FOR A FLAT-BOTTOM BOAT

RELATED APPLICATIONS

The present invention was first described in and claims the benefit of U.S. Provisional Application No. 61/920,925, filed Dec. 26, 2013, the entire disclosures of which are incorporated herein by reference.

FIELD OF THE INVENTION

The present invention relates generally to an apparatus that attaches to the exterior hull of a watercraft designed to prevent the sound of waves slapping against the side or bottom of the watercraft.

BACKGROUND OF THE INVENTION

Fishing is a hobby-type sport that is enjoyed around the world by the young and old alike. After the fishing rod and tackle box, the fishing boat is the next most common piece of apparatus used in fishing. One (1) of the most common types of boats, especially for use in shallow water, is the flat bottomed or "Jon" boat. Such boats are easily maneuverable, stable, and provide a large amount of room for multiple fishermen. However, one drawback associated with their use is that waves will "slap" against the nearly vertical side of the boat creating a noise. This noise is very unnatural sounding to marine life that may be nearby, and as a result the fish immediately leave the area. As such, the reduced number of fish will result in a lower catch ratio. Accordingly, there exists a need for a means by which the features and benefits of a flat bottomed boat can be enjoyed without the risk of slapping waves and the resultant lack of caught fish. The use of the present invention provides fishermen the ability to increase their catch of fish while fishing from a flat bottomed boat in choppy water.

SUMMARY OF THE INVENTION

The disadvantages of the prior art are overcome by the present invention in providing a hydraulic baffle that comprises a baffle panel and a cover that encases the baffle panel. The cover includes a plurality of fasteners that allow the baffle panel to be operatively affixed to the outer side of a hull of a watercraft to absorb water impact and suppress ay resultant sounds. The use of the present invention provides fishermen the ability to increase their catch of fish while fishing from a flat bottomed boat in choppy water.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
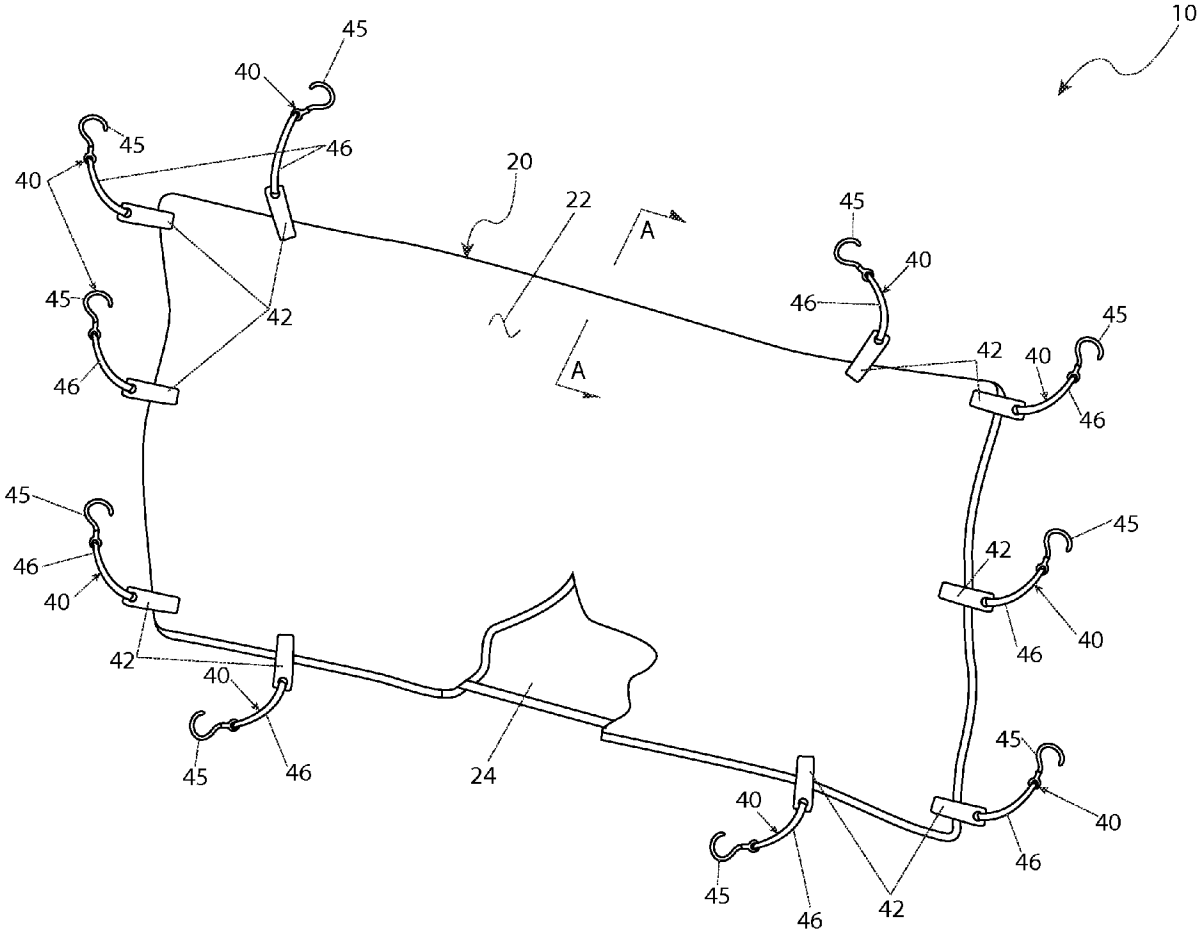
FIG. 1 is a perspective view of a hydraulic baffle for boat hulls 10, according to the preferred embodiment of the present invention.

10 hydraulic baffle for boat hulls
20 baffle assembly
22 cover
24 baffle panel
26 stitching
25 channel
40 fastening means
42 tab
43 grommet
45 hook
46 elastic cord
47 knot
48 hook aperture
49 coating
50 watercraft
55 gunwale
57 hull
60 water/water line

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 4:
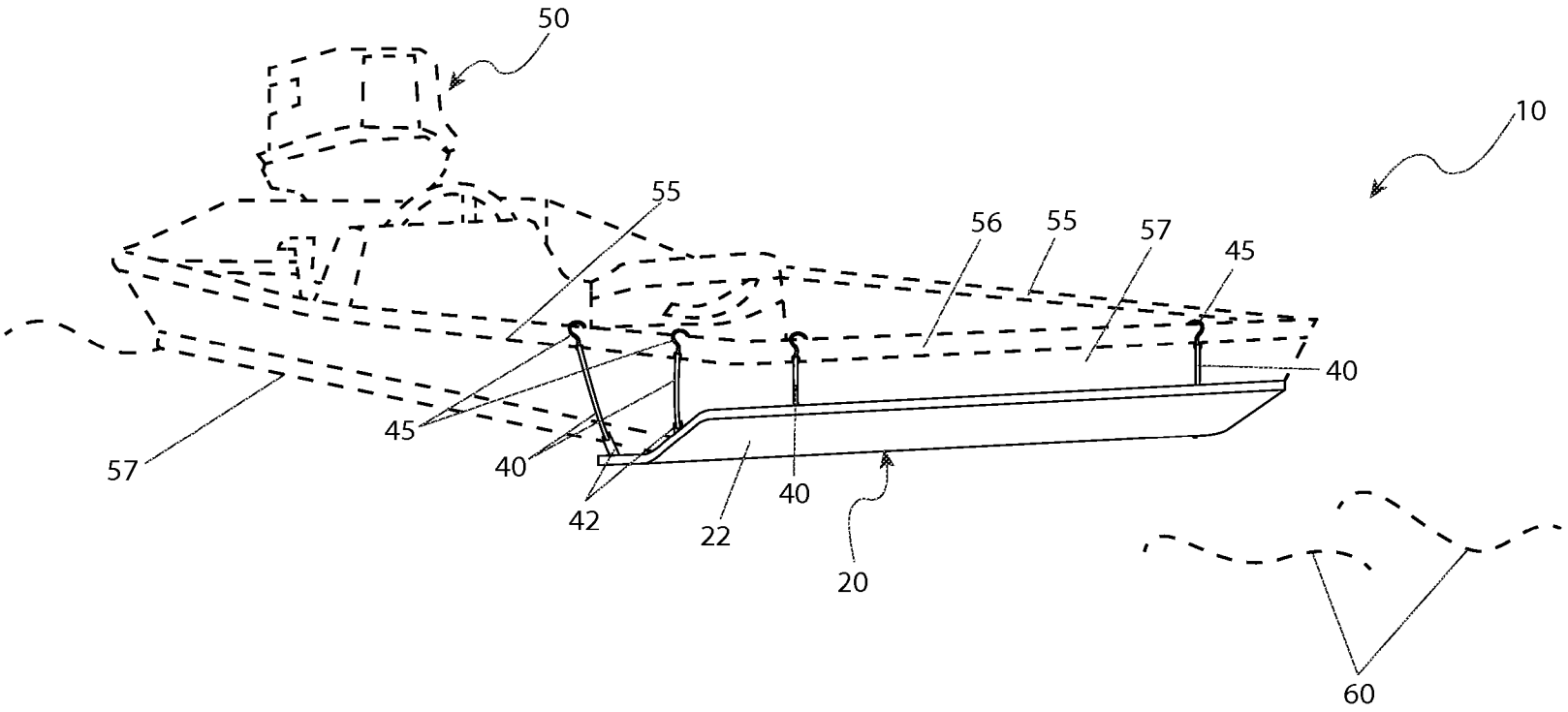

As indicated in FIG. 4, the present invention describes an apparatus and method that provides a means to suppress the production of sound from the impact of water 60 slapping against an exterior hull 57 of a watercraft 50 as the watercraft 50 is anchored and at rest or moving at a slow trolling pace. The hydraulic baffle (herein described as the "apparatus") 10 comprises a baffle assembly 20 which wraps around a bow portion 56 of the watercraft 50, being affixed securely to gunwale portions 55 of the watercraft 50 via a plurality of fastening means 40. It should be appreciated without limitation however, that depending upon environmental factors, that at any given time it may be more desirable to place the apparatus on either side of watercraft, vice the bow, were the movement of the water impacting a side surface of the watercraft 50.

Figure 2:
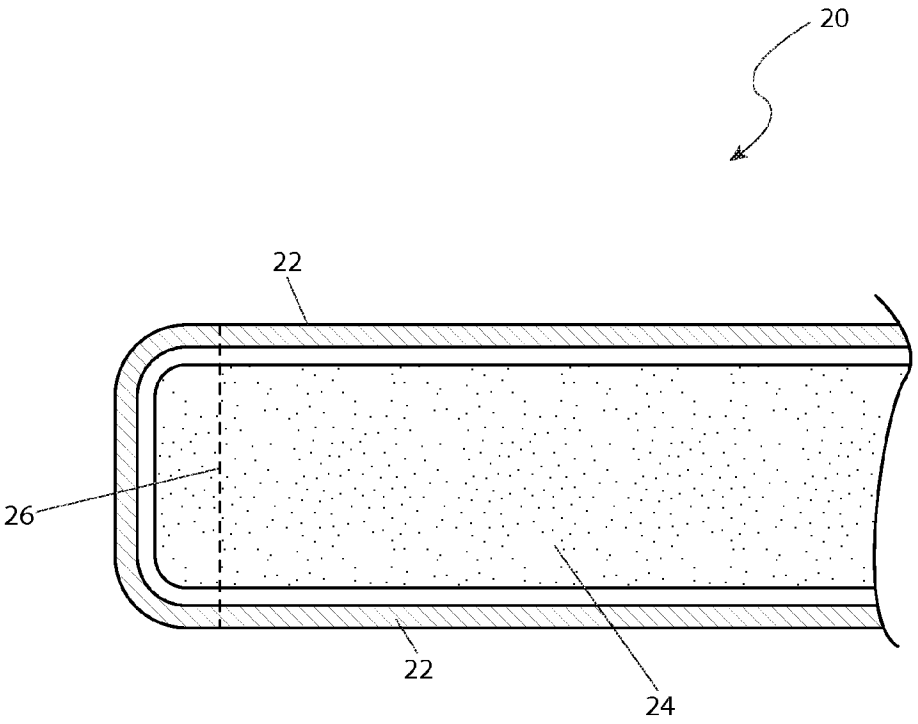
FIG. 2 is a sectional view of the hydraulic baffle for boat hulls 10 taken along section line A-A (see FIG. 1), according to the preferred embodiment of the present invention.

Referring now to FIGS. 1 and 2, perspective and sectional views of the apparatus 10, are disclosed according to the preferred embodiment of the present invention. The baffle assembly 20 provides a means to absorb the hydraulic energy affected upon the outer surfaces of a watercraft 50 by the motion of the surface of a body of water 60 and thereby suppress the resultant sound. This is accomplished by covering a portion of the outer surfaces of the watercraft 50 with the baffle assembly 20. The baffle assembly 20 comprises a baffle panel 24 that is retained and encapsulated by first and second side cover portions 22. Due to the general shape of the watercraft employed in the envisioned activity, such that of a "Jon" boat, a "skiff", or the like style watercraft, the most common area of undesirable sound production from the water impact is in the area of the sloped bow. In this manner, the baffle assembly 20 will most often be employed on the forward bow area of the watercraft 50 (see FIG. 4).

The baffle panel 24 is envisioned being made using a highly buoyant flexible material being approximately one-quarter of an inch (¼ in.) thick, and providing a particular embodiment being approximately three feet (3 ft.) in width and six feet (6 ft.) in length; however, it is understood that the apparatus 10 would be introduced in various embodiments having various respective sizes such as small, medium, and large for attachment to different sized watercraft 50, and as such should not be interpreted as a limiting factor. Furthermore, it is envisioned that the baffle assembly 20 would be made available in different colors and patterns based upon various fishing applications and a user's preference.

The highly buoyant flexible material envisioned for the baffle panel 24 is a foam-type product having a uniform internal cell structure providing excellent floatation and cushioning properties, and being similar to insulation products manufactured by VOLARA®. The baffle panel 24 is to be completely encased within a cover 22 being assembled together and sewingly attached to the baffle panel 24 via linear stitching 26 along perimeter edges which penetrates through the baffle assembly 20. The stitching 26 is envisioned to use marine-grade materials and utilize common commercial sewing methods. The cover 22 is preferably made using an acrylic coated polyester marine fabric similar to like materials manufactured by ROCKYWOODS®, or an equivalent flexible waterproof textile material (see FIG. 3). The cover 22 further includes a plurality of sewn-on textile tabs 42 made of strong strapping sections using a similar material as the cover 22. The tabs 42 are to be spaced along and sewingly attached to perimeter edges of the baffle assembly 20.

The tabs 42 work in conjunction with respective fastening means 40 to attach the apparatus 10 to the watercraft 50. The apparatus 10 is shown here having four (4) fastening means 40 arranged around each end portion for illustration sake; however, it is understood that any number of fastening means 40 could be affixed to perimeter edges of the apparatus 10 based upon various watercraft 50 and environmental conditions, and as such should not be interpreted as a limiting factor. The fastening means 40 incorporate elastic cords 46 fabricated of a substance that contains high elasticity to permit a stretching tension to be applied thereto. The elastic cords 46 in turn are affixed to hooks 45 being of a suitable size and shape to securely fasten the apparatus 10 to gunwale portions of the watercraft 50 along side and bow portions (see FIG. 3).

Figure 3:
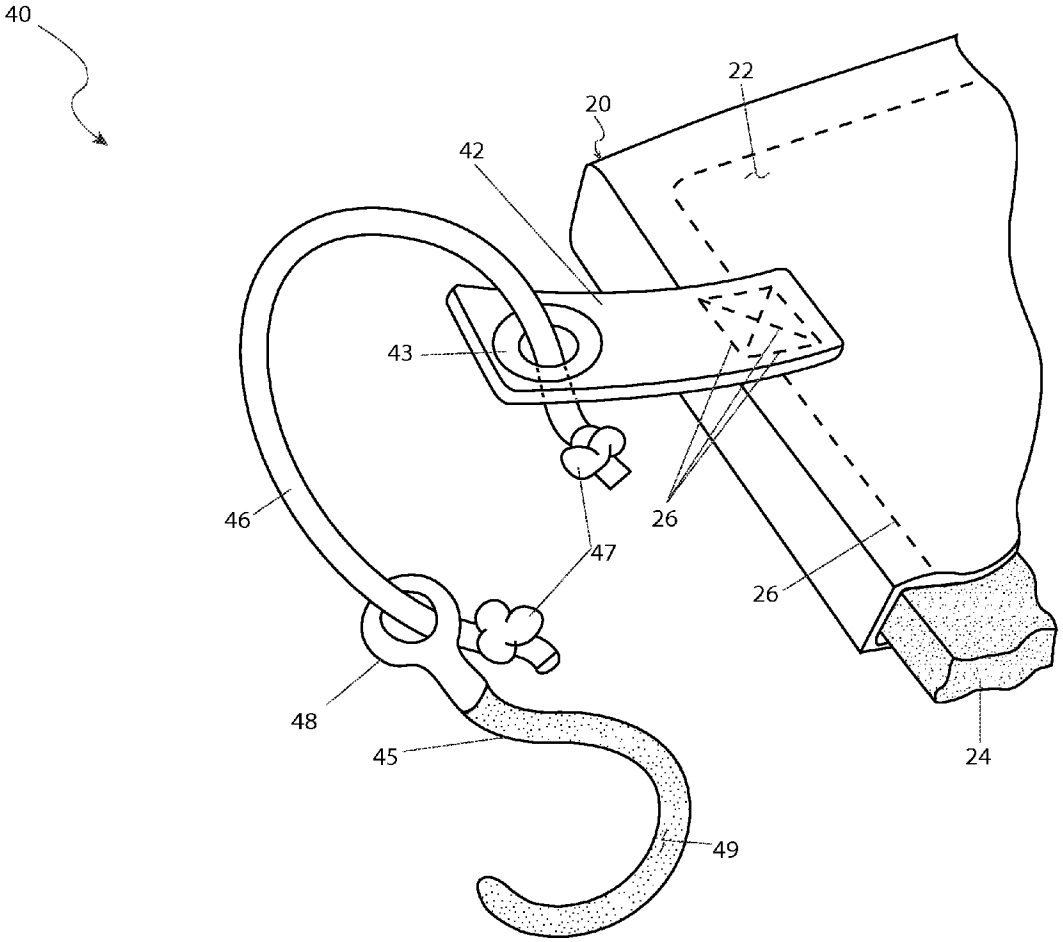
FIG. 3 is a close-up view of a fastening means portion 40 of the hydraulic baffle for boat hulls 10, according to the preferred embodiment of the present invention; and, FIG. 4 is an environmental view of the hydraulic baffle for boat hulls 10 being removably attached to a watercraft 50, according to the preferred embodiment of the present invention.

More specifically, referring now to FIG. 3, a close-up view of a fastening means portion 40 of the apparatus 10, according to the preferred embodiment of the present invention, is disclosed. The apparatus 10 provides a means of attachment to various types of watercraft 50 via a plurality of strap-type tabs 42. The tabs 42 are sewingly affixed along a perimeter edge of the baffle assembly 20 using stitching 26 to affix a proximal end of each tab 42 to the cover portion 22 of the baffle assembly 20. Each tab 42 includes an integral metal or plastic grommet 43 at a distal end which in turn facilitates attachment of the proximate end of an elastic cord 46. The elastic cord 46 extends to its distal end which is inserted through a hook aperture 48 of the hook 45. The elastic cord 46 is knotted 47 at both its distal and proximate ends to secure it to both the tab 42 and the hook 45. The hook 45 is envisioned being made using a strong plastic or a corrosion-resistant metal material, and further providing a soft rubber or plastic exterior coating 49 to protect surfaces of the watercraft 50 from scratching when attached. Although shown here having an arcuate profile, the hook 45 may be introduced having various profiles such as a "J"-shape or a "U"-shape having square or rounded corner portions so as to match a profile of a receiving gunwale portion 55 of a particular model and type of watercraft 50.

Referring now to FIG. 4, an environmental view of the apparatus 10 being removebly attached to a watercraft 50, according to the preferred embodiment of the present invention, is disclosed. The apparatus 10 is to be ruggedly constructed so as to withstand the stress and strain experienced by a hull portion 57 of the watercraft 50 during use, as well as being able to resist forces that may be exerted by underlying rocks, branches, and/or debris that may be present in the water 60.

The apparatus 10 provides fastening means 40 suitable for attachment to various watercraft 50 such as flat-bottom boats, semi-V hulls, Fiberglass bass boats, and the like. The fastening means 40 extend upwardly from the baffle assembly 20 and are preferably affixed to the upper gunwale portions 55 of the watercraft 50. The fastening means 40 provides a stretching tension upon the hooks 45 which in turn wrap around the gunwale portions 55. The fastening means 40 of the apparatus 10 enable placement along front, side, or rear surface of the watercraft 50. The hooks 45 may also be positioned or utilized to attach to other fixedly rigid components of the watercraft 50 in addition to or instead of the gunwale portions 55 of the watercraft 50. For example, the hooks 45 may be removably installed onto a seat bracket, a seat, and/or other fixedly rigid components of the watercraft 50. The terms "front" and "rear" are not intended to be strictly interpreted as the orientation, but rather being utilized for description purposes only and is arbitrary to the view chosen.

The apparatus 10 is envisioned to be installed such that a portion of the baffle assembly 20 is submerged beneath the water line 60; however, it will be appreciative that the apparatus 10 may be positioned so that the submerged portion may be any portion of the total length of the baffle assembly 20 based upon placement of the apparatus 10 onto the hull 57 of the watercraft 50. It is further envisioned that the apparatus 10 will be affixed to the hull 57 of the watercraft 50 in a position relatively opposite to that side at which a boat motor resides. However, the placement of the apparatus 10 is dependent on the watercraft 50 design, water conditions, the utilization of a motor, the manner in which the watercraft 50 is intended to be utilized, and other conditions and user preferences. When the watercraft 50 is in motion or at a steady state, the compliant nature of the apparatus 10 applies a restorative force to the hull 57 to prevent undesired motion, bobbing, or the generation of ripples in the water 60. The apparatus 10 thus serves as a tool to improve a fishing activity by lessening the chances of frightening fish in the area. This is accomplished by reducing movement of the watercraft 50, reducing sound created by the contact of choppy water with the hull 57, and minimizing ripples throughout the water surface 60.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be configured as indicated in FIGS. 1, 3, and 4. The method of utilizing the apparatus 10 may be achieved by performing the following steps: procuring a model of the apparatus 10 having a desired color, overall size, and number of fastening means 40 with desired hook 45 types; motioning the baffle assembly 20 angularly towards the hull 57 of the watercraft 50 so as to mimic a silhouette of the hull 57; stretching the elastic cords 46 of the fastening means 40 so that the respective hooks 45 may reach a desired location upon a gunwale 55 or other suitable attachment site upon the watercraft 50; installing each hook 45 onto the gunwale 55; and, experiencing an enhanced fishing activity, afforded a user of the present invention 10.

The apparatus 10 is specifically designed to minimize sound that may be inflicted upon a hull 57 by wave induced water 60 coming in contact with the watercraft 50. The lack of sound is envisioned to lessen the chances of frightening any fish. As such, the fish are more likely to approach the watercraft 50 and take the bait. The use of the apparatus 10 provides users who desire to fish the ability to increase their catch of fish while fishing from a watercraft 50, such as a flat-bottomed boat, even in choppy water. During use, it is envisioned that the watercraft 50 would be positioned so that the apparatus 10 faces oncoming waves. Thus, as the waves would break against the hull 57, the baffle assembly 20 would absorb the sound energy, thereby resulting in diminished audible sound.

The apparatus 10 utilizes a fastening means 40 to facilitate the attachment of the apparatus 10 onto the hull 57 of a watercraft 50. The elastic nature of the elastic cords 46 attached to the baffle assembly 20 allows a taut installment to the watercraft 50. With this installment, an oncoming wave or motion of water will come into contact with the baffle assembly 20 rather than the hull 57 of the watercraft 50.

Once utilization of apparatus 10 is complete, the apparatus 10 is easily detachable from the watercraft 50 simply by disconnecting hook portions 45 of the fastening means 40 whenever desired. When docking a watercraft 50, the apparatus 10 may be removed prior to docking by the easily accessible fastening means 40 attached to the gunwale 55 of said watercraft 50. Alternatively, the apparatus 10 may be removed after docking or removal of the watercraft 50 from the water 60 without worry of damage being inflicted upon said apparatus 10.

The use of the apparatus 10 will act to quiet and settle the watercraft 50 when in a stationary or steady state. Further, the apparatus 10 will provide a smoother ride while the watercraft 50 is in motion due to the baffling of hydraulic energy. Based upon particular hull designs 57, the apparatus 10 may also provide the beneficial feature of better control of the watercraft 50 about the roll, pitch, and yaw axis while the watercraft 50 is in motion and/or static in additional to the primary feature of reducing noise, splashing, and ripples through the water 60.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A hydraulic baffle, comprising:

a baffle panel comprising a foam product having a uniform cell structure; and, a cover encasing said baffle panel;

wherein said baffle panel is operatively affixed to a bow of a watercraft to lessen a force of water impact; and, wherein said baffle panel extends outward and away from said watercraft at an angle exceeding 90 degrees.

2. The baffle of claim 1, further comprising a plurality of fastening means disposed on said baffle panel, each said fastening means comprising:

a tab portion having a proximate end affixed to an outer edge of said panel;

an elasticized portion having a proximate end affixed to and extending from a distal end of said tab portion; and, a hook affixed to a distal end of said elasticize portion;

wherein each said hook portion is adapted to be engaged to a portion of said bow to secure said baffle.

3. The baffle of claim 2, wherein each said fastening means further comprises:

a grommet disposed in said distal end of said tab portion; and, a hook aperture disposed at the proximate end of said hook;

wherein said elasticized portion is a cord with said proximate end inserted through said grommet and said distal end inserted through said hook aperture and said cord is knotted at said proximate and said distal ends.

4. The baffle of claim 1, wherein said cover comprises:

a first side; and, a second side;

wherein said first and said second sides are disposed about said baffle panel and sewingly affixed by stitching said first and second sides together to secure and encapsulate said baffle panel within.

5. A hydraulic baffle, comprising:

a baffle panel comprising a foam product having a uniform cell structure;

a cover having a first side and a second side that receive and encase said baffle panel; and, a plurality of fasteners, each comprising an elasticized portion and a hook;

wherein said fasteners are operatively disposed about a perimeter edge of said baffle panel to affix said baffle panel to a bow of a watercraft to lessen a force of water impact; and wherein said baffle panel extends outward and away from said watercraft at an angle exceeding 90 degrees.

6. The baffle of claim 5, wherein said cover is disposed about said baffle panel and sewingly affixed by stitching said first and second sides together to secure and encapsulate said baffle panel within.

7. A hydraulic baffle, comprising:

a baffle panel comprising a foam product having a uniform cell structure;

a cover encasing said baffle panel; and, a plurality of fasteners comprising:

a tab portion having a proximate end sewingly affixed to an outer edge of said baffle panel and a grommet affixed to a distal end;

an elastic cord having a proximate end affixed to and extending from said grommet; and, a hook having a coated hook end affixed to a distal end of said elastic cord;

wherein each said hook is adapted to be engaged to a portion of a bow of a watercraft to secure said baffle; and, wherein said baffle panel extends outward and away from said watercraft at an angle exceeding 90 degrees.

* * * * *